US008245946B2

(12) United States Patent
Greenthal et al.

(10) Patent No.: US 8,245,946 B2
(45) Date of Patent: Aug. 21, 2012

(54) METHOD AND APPARATUS FOR CONSERVING WATER

(75) Inventors: Steven M. Greenthal, Buena Park, CA (US); Neal W. Smith, Blue Springs, MO (US)

(73) Assignee: Nitroworks Corporation, Buena Park, CA (US)

( * ) Notice: Subject to any disclaimer, the term of this patent is extended or adjusted under 35 U.S.C. 154(b) by 929 days.

(21) Appl. No.: 11/974,812

(22) Filed: Oct. 16, 2007

(65) Prior Publication Data

US 2009/0095356 A1 Apr. 16, 2009

(51) Int. Cl.

| | |
|---|---|
| ***G05D 23/12*** | (2006.01) |
| ***G05D 23/185*** | (2006.01) |
| ***F16K 49/00*** | (2006.01) |
| ***F16L 53/00*** | (2006.01) |

(52) U.S. Cl. ..... 236/12.13; 236/12.1; 236/12.11; 137/337

(58) Field of Classification Search ..... 236/12.1, 236/12.11, 12.13, 12.14; 137/337; 4/679, 4/682

See application file for complete search history.

(56) References Cited

U.S. PATENT DOCUMENTS

| | | | | |
|---|---|---|---|---|
| 2,688,338 | A | 9/1954 | Newell | |
| 4,160,461 | A | 7/1979 | Vataru et al. | |
| 4,249,695 | A | 2/1981 | Dreibelbis | |
| 4,697,614 | A | 10/1987 | Powers et al. | |
| 5,339,859 | A | 8/1994 | Bowman | |
| 5,452,740 | A | 9/1995 | Bowman | |
| 5,603,344 | A | 2/1997 | Hall, Jr. | |
| 5,775,372 | A | 7/1998 | Houlihan | |
| 6,032,687 | A | 3/2000 | Linn | |
| 6,318,400 | B1 | 11/2001 | Hope et al. | |
| 6,425,148 | B1 | 7/2002 | Chen | |
| 6,651,574 | B1 | 11/2003 | Ellens et al. | |
| 6,655,405 | B2 | 12/2003 | Hollister et al. | |
| 6,997,200 | B2 | 2/2006 | King | |
| 7,073,528 | B2 * | 7/2006 | Kempf et al. | 137/337 |
| 7,100,636 | B2 | 9/2006 | King | |
| 7,243,671 | B2 | 7/2007 | Thrash, Jr. et al. | |
| 7,392,955 | B1 * | 7/2008 | Laing | 236/12.13 |
| 2004/0040601 | A1 * | 3/2004 | Koelzer | 137/522 |
| 2005/0205680 | A1 * | 9/2005 | Valente | 236/12.11 |

* cited by examiner

*Primary Examiner* — Chen Wen Jiang
*Assistant Examiner* — Daniel C Comings
(74) *Attorney, Agent, or Firm* — Erickson, Kernell, Derusseau & Kleypas, LLC

(57) ABSTRACT

A unitary valve block assembly is interposed between a hot and cold water outlet and a faucet assembly including a hot and cold valve to convey the initially cold portion from the hot water outlet into an accumulator during all the times when the accumulator is substantially unfilled. This accumulated water is then emitted through the cold water valve each time cold water is demanded. When the pressure ratio between the accumulator and the water source indicates that it contains substantial quantities of un-evacuated stored water the subsequent demands of hot water are conveyed directly to the hot water valve regardless of the temperature thereof.

13 Claims, 3 Drawing Sheets

METHOD AND APPARATUS FOR CONSERVING WATER

BACKGROUND OF THE INVENTION

1. Field of the Invention

The present invention relates to an apparatus and method for collecting and thereafter recycling the initially cold portion of a household hot water stream that is usually wasted, and more particularly to a temperature sensing water flow diversion circuit that directs the initially cold part of the hot water flow into an accumulator for subsequent cold water use.

2. Description of the Prior Art

With increasing population density prudence in the use of the world's resources has become a dominant concern. One resource that is central to all the functions of life is potable water, a resource that is growing scarce and is therefore now the primary concern of most municipalities. Simply, the availability of fresh water now limits most municipal growth and virtually all housing expansions are currently associated with costly water recycling or conservation measures, a cost exchange that will only continue to rise in a world that increases in its mean temperature.

For a long time it has been recognized that one substantial component of unnecessary water waste is the early, cool part of a hot water stream that is currently just dumped down the drain until the desired stream temperature is reached. In multiple dwelling structures these losses can become quite large and the economies of scale have led to the use of continuously circulating hot water loops which shorten substantially the length, and therefore the volume, of the branch circuits feeding each hot water valve. While these continuously circulating arrangements have obtained substantial savings in water use, the sheer number of the various circuits that branch off from the loop results in significant waste of fresh water nonetheless.

In the past various mechanisms have been proposed that in one way or another divert the initial part of the hot water stream into an accumulator or other storage cavity to be saved and thereafter drained with the cold water flow as cold water is demanded. While suitable for the purposes intended most of the prior mechanisms fail to fully address the volumetric requirements of such storage, i.e., the physical size and cost of the storage reservoir itself, and also its distribution throughout a household and therefore the necessary household space burden devoted thereto.

Those skilled in the art, of course, will appreciate that an exactly paired hot water—cold water demand sequence is rare in a household, just like exactly sequenced heads—tails pairings in any statistical process, and a typical residential bathroom will therefore need to accommodate several hot water demand initiation sequences in its reservoir sizing. Simply, any practical implementation will need a volumetric storage capacity surplus that will accommodate several hot water—hot water sequences in a row in order to be useful since a full storage reservoir cannot provide the needed diversion volume at all. In a busy household where the sequential morning hot water demands often exceed the water heater capacity, and little or no cold water is added to cool the stream, a practically sized accumulator needs to accommodate several hot water demands each of a volume equal to the volume of the utilized plumbing branch.

Moreover, to optimize the reservoir volume one must also consider the efficacy of the reservoir draining process itself, a process effected when cold water is demanded since the same statistical processes operate also on the cold water side. To obtain full benefit this draining rate should be maximized, i.e., should be at the full cold water flow demanded, thus limiting the usefulness of any drainage mechanism in which the draining flow is entrained with, and/or carried along by, the primary cold water flow. Simply, to assure maximal reservoir drainage rates and thus improve any statistical bias the drained volume in each of the cold water incidents needs to be maximized.

The foregoing volumetric concerns are not the whole of it. Like in any statistical process the probabilities of long sequences of uninterrupted repeating hot water demands are sufficiently significant that even a very large reservoir sizing will be quickly exceeded. To accommodate these real possibilities the water conserving system will either need to include very large and therefore costly reservoirs or must automatically revert to a by-passing state in order to retain the original basic water supply functions.

While these several concerns have perhaps had individual attention in the prior art, the complete combination of all these notions has not been fully accommodated. For example U.S. Pat. No. 4,697,614 to Powers et al., while teaching a diversion into the accumulator of the initial hot water stream, does so by a manually effected selector. The collected water in the accumulator is thereafter drained by entrainment with a reduced pressure cold water flow. While suitable for the purposes intended this particular arrangement demands manual attention to effect its use while also protracting the accumulator drainage by the reduced flow therefrom.

By further example U.S. Pat. Nos. 5,339,859 and 5,452,740, both issued to Bowman, while each replacing the manual selector with a temperature sensing flow control in the hot water circuit, similarly fail to optimize the draining part of the process, with the '740 patent resolving the drainage paradox by directing the accumulated water to irrigate plants. While once more each of these references, and the many others, achieve their respectively intended purposes, the central concern of a convenient, fully automated conservation arrangement has not been fully addressed.

Thus the full hot and cold water use dynamics of a typical household are neither fully appreciated nor attended at all in the prior art and because of the complex interplay of these several functions the well appreciated benefits of water conservation have not been fully realized. An automated system that fully accommodates these several competing functions in a manner that is virtually imperceptible to the user is therefore extensively desired and it is one such system that is disclosed herein.

SUMMARY OF THE INVENTION

Accordingly, it is the general purpose and object of the present invention to provide an automated flow control system which diverts the initially cold portion of the water flow in the hot water circuit into an accumulator and drains the accumulator with each opening of the cold water circuit.

Other objects of the invention are to provide an automated flow control system that diverts the initially cold portion from a hot water circuit into a closed storage reservoir in accordance with the temperature thereof and thereafter drains the diverted water from the reservoir into the cold water flow by way of a flow preference valve.

Yet further objects of the invention are to provide a fully automated household water flow control system that diverts the initially cold portion of the hot water flow for storage and that otherwise retains the customary hot and cold water controls when the storage capacity is reached.

Briefly, these and other objects are accomplished within the present invention by providing a temperature activated diverter valve in the hot water circuit that directs the initially cold portion of the hot water flow into an inlet mechanism on an accumulator once hot water is selected at the faucet assembly. When the accumulator is full, however, its inlet assembly redirects this initial flow into the open hot water outlet which, while defeating the water conservation aspects thereof, continues the operative functions of the faucet assembly. In this manner the basic functions of the faucet assembly are retained for the user even though the conservation aspects are temporarily lost.

To implement these functions the accumulator inlet assembly includes a branching connection controlled by a first and second check valve and an accumulator ratio shuttle where the first check valve directs the initial hot water flow either into the accumulator interior or, when the accumulator is full, across the second check valve into the opened hot water outlet, with this same ratio shuttle providing an accumulator draining flow preference when the cold valve is opened.

More precisely, the ratio shuttle resolves the pressures thereacross by the area ratio of its respective opposed faces, with the larger shuttle area exposed to the accumulator interior while the smaller face area sees the cold water circuit. When the accumulator begins to fill its internal pressure reaches that of the circuit with the larger area ratio resulting in a displacement bias to the smaller side to close the cold water path in favor of a draining path until the accumulator pressure is completely relieved. A similarly implemented demand shuttle is also rendered operative by presenting the outlet pressure at the hot water valve to its larger shuttle area while the smaller face sees the hot water source until it reaches the set temperature and is therefore passed across the temperature actuated shuttle.

In this manner the continued operation of the faucet assembly is assured at all the fill states of the accumulator, resolving the potential statistical paradox encumbering most of the prior art devices, a paradox that may occur when too many hot water initiations are demanded in a single sequence that heretofore was not effectively resolved. Those skilled in the art will appreciate that these periods of repeated hot water demand tend to follow temporal patterns, e.g., the need for a morning hot shower by all those in a household will result in residual latent heat stored in the branch circuit which will bypass the accumulator cycle, thereby reducing the water accumulated, lowering the potential to fill and waste. The inventive by-pass therefore accommodates these use patterns by resolving what heretofore was an operational paradox but in a setting that minimizes waste.

It will be particularly appreciated by those skilled in the art that each of the operative aspects is obtained in response to the opening of a cold or hot water valve, an attribute that is particularly useful with faucet assemblies provided with a single selector arm. Moreover, each of the above operative functions are effected by shuttles or check valves that are completely confined with little or no prospective incidence of leakage to the outside. Simply, once hot or cold water demand begins the corresponding shuttles automatically select the operational state by the lower pressure that results in the particular circuit. Thus the usual operation of a conventional faucet assembly will be converted into a state selection by a hydraulic latch obtained by the area multiples across the several shuttles, thus eliminating most of the disadvantages that have plagued some of the conservation devices earlier proposed.

The effectiveness of the conservation system instantly described can be enhanced even further by interconnections between several accumulators within the household or by connecting several units to a single larger sized accumulator. Since most residential construction attempts to localize bathrooms and other water dispensing facilities to reduce the cost and losses of plumbing circuits the typical back-to-back arrangements are particularly convenient in effecting accumulator interconnections so that the statistical accumulator logjam in one bathroom is shared with another. Thus the unused guest bathroom can help to maintain the conservation efficacy in the busier bathroom across the wall, an attribute that is rendered convenient by the ease of installation and inherent reliability of the inventive system.

In this manner water conservation can be reliably and effectively assured in a device that is easily retrofitted to encourage its wide use, as more precisely described by specific reference to the illustrations below.

DESCRIPTION OF THE PREFERRED EMBODIMENTS

Figure 1:
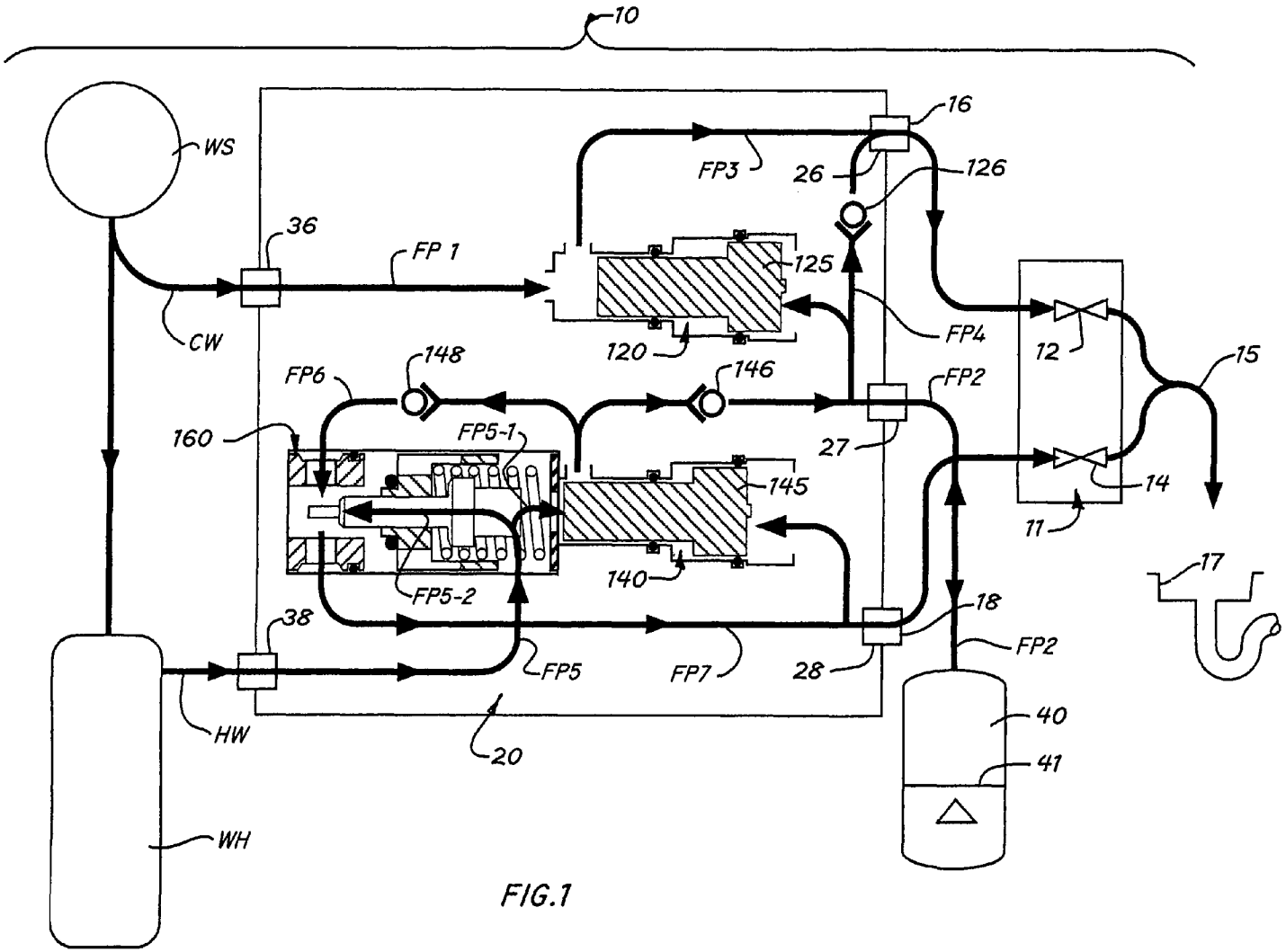
FIG. 1 is a diagrammatic illustration of one exemplary plumbing circuit incorporating the inventive conservation system in a portion thereof.
Figure 2:
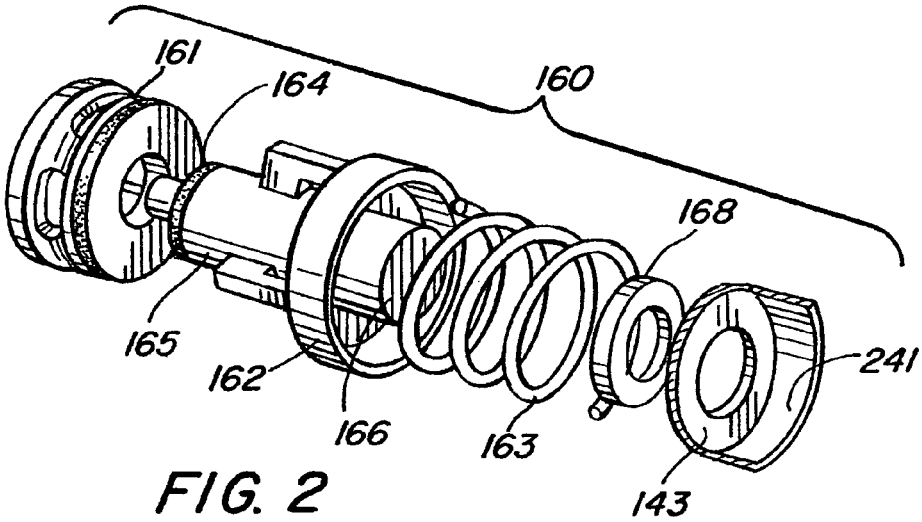
FIG. 2 is a perspective view, separated by parts, of the respective operative portions of a temperature activated shuttle valve directing the flow through a plenum cage defining an alternative flow path in accordance with its first shuttle position corresponding to a sensed low temperature and a second position corresponding to a sensed high temperature to open a second flow path therethrough.

As shown in FIGS. 1-4, the inventive water conservation system, generally designated by the numeral 10, comprises a conventionally implemented faucet assembly 11 provided with a cold water valve 12 and a hot water valve 14 each conventionally conformed for connection by known water tight connectors 16 and 18 either directly to the local water supply WS or to the outlet of a conventional water heater WH that form the corresponding cold water and hot water plumbing branches CW and HW running through a household. By well known conventional practice valves 12 and 14 are either coordinated for operation by a single, manually articulated lever or by individually associated mechanisms that control the flow therethrough into a common outlet 15.

Of course, ordinary prudence demands that all excess flow from each faucet assembly be confined by a tub, sink basin, shower pan or the like, and conveyed through a drain 17 into the sewer. In conventional practice this excess flow also included the wasted water stream released through the hot water valve 14 until the desired temperature was reached.

To limit this loss of clean water the inventive conservation system 10 interposes between connections 16 and 18 and the corresponding cold and hot water branches CW and WW a unitary valve block 20 respectively joined at its outlet connections 26 and 28 to the valve connections 16 and 18, thereby completing the circuits to supply valves 12 and 14, and by inlet connections 36 and 38 to the hot and cold water branches HW and CW to direct the heretofore wasted flow into an accumulator 40 also tied to the valve block to across a further outlet connection 27. Of course, since the valve block 20 is intended for interposing connection between the faucet assembly that is usually fixed in its location and the locally available hot and cold water branches that are also fixed, all the inventive functions thereof need to be imperceptible to the user.

Simply, in order to be useful all the inventive functions need to be effected in response to conventional articulations of familiar valve mechanisms, without any direct mechanical connection with the user. Moreover, these same replacement constraints also impose a size limitation on the valve block to a size that will fit into the available spaces under a sink, or in spaces between wall studs, and the accumulator itself may also be similarly sized to fit in a sink console or between typical wall stud spacing.

All these constraints are inventively accommodated within block 20 by a set of manifolded and check valve regulated interconnections between two shuttle valve assemblies 120 and 140, each including a shuttle defined by two differently sized opposing piston faces of a corresponding piston assembly 125 and 145 that are shuttled between the limits of corresponding bores in response to the force differentials across each shuttling piston assembly. It is these shuttling movements that then close and/or open the several alternative flow paths through the valve block, that resolve the flows through a temperature activated valve assembly 160 into or out of the accumulator and the respective faucet valves.

More precisely, within the accumulator ratio shuttle assembly 120 its piston assembly 125 includes a smaller piston 121 at one end that in the course of its stroke closes a valve seat 123 and a lateral port 127 and an opposed larger piston 122 that communicates with a check valve 126 and also with accumulator 40. The accumulator ratio assembly 120 effectively amplifies the comparison of the pressure difference between the water supply WS and the accumulator by the piston area ratio, and if the accumulator has fluid the shuttle closes the cold water flow at seat 123 and replaces it by accumulator drainage flow across the check valve.

Similarly, shuttle assembly 140 also includes a piston assembly 145 comprising a smaller piston 141 closing a seat 143 and a lateral port 147 at the end of its stroke and an opposing larger piston 142 at the other end that communicates with the hot water faucet valve 14 but in this setting it is the pressure drop at the larger piston associated with the opening of valve 14, as multiplied by the piston area ratio, that articulates the shuttling stroke. The hot water flow input to seat 143 originates at the temperature activated valve assembly 160 comprising a follower cage 162 mounted on a bias spring 163 and provided with a seal 164 axially mounted on a thermostatic actuator 165 that extends into the annular interior of a plenum cage 161 against which the sealing contact is made.

An axially aligned cylindrical plug 166 at the other end of the thermostatic actuator 165 then extends into the common annuli of the follower cage 162 and spring 163 to compress a sealing washer 168 on the exterior face of the seat 143 of shuttle assembly 140 when the thermostatically set temperature is reached. Accordingly, in this position of the thermostatic actuator 165 the hot water flow that enters into the valve assembly 160 through a lateral port 167 is conveyed through the follower cage 162 and across the open seal 164 into the plenum cage 161 to be then conveyed into the outlet 28 and then through the open valve 14.

Before the set temperature is reached, however, the lower pressure level at piston 142 that is associated with the opening of the hot water valve 14 articulates the piston assembly 145 to open the seat 143 allowing the conveyance of hot water into the lateral port 147 from where it is branched to check valves 146 and 148, the first feeding the accumulator and the latter opening a flow path through the plenum cage 161 to the outlet 28, by-passing the conservation functions during those instances when the accumulator is too high.

The several flow paths that are thus formed are best appreciated by particular reference to FIG. 1. Focusing on the draining process of accumulator 40 first, the cold water flow CW follows the flow path FP1 across inlet connection 36 to the inlet of the shuttle assembly 120 controlled by a valve seat 123 that is opposed by the smaller piston 121 of piston assembly 125 shuttling within its interior which, at the opposite side, includes the larger piston 122 that communicates directly through flow path FP2 with accumulator 40, and therefore is exposed to its internal pressure. Thus when the total force on the smaller piston 121 is greater than the total force on the larger piston 122, i.e., when the accumulator is close to empty, piston 121 shuttles away from seat 123 allowing the water flow from path FP1 to exit through a lateral port 127 now exposed and thence along path FP3 to the open cold water faucet 12.

If, however, the accumulator is begins to fill and its internal pressure increases, then the multiple of the piston ratios forces piston assembly 125 to close valve seat 123 directing the flow from path FP2 to check valve 126 to form a draining flow path FP4 each time valve 12 is opened. Once fully drained the drop in the pressure at the larger piston 122 opens seat 123 and also the port 127 and the cold water from branch CW then continues through valve 12. Thus every time the cold water valve opens the accumulator is drained in a hydraulically latched operation that is obtained through the use of unequal pistons.

Those skilled in the art will appreciate that the foregoing latching articulation is essentially imperceptible to the user and will occur each time cold water is demanded. Simply, whenever the total force at the larger piston face 122 exceeds the total force at the smaller piston face 121 valve seat 123 is closed while a draining path from the accumulator opens to replace the blocked cold water stream. Since a conventional accumulator, and also accumulator 40, typically include a pressure biasing membrane 41, the net result is that virtually all the water in the accumulator will be drained whenever valve 12 remains open for a sufficient period.

On the hot water side the flow path FP5 from the hot water circuit HW feeds both the valve seat 143 and also the follower cage 162. Until the thermostatic actuator 165 opens the only path for the hot water flow is then along the flow path FP5-1 that branches from path FP5 through seat 143 and then through port 147 to the opposed check valves 146 and 148 which are biased such that if the accumulator pressure is low, indicating an empty accumulator, check valve 146 opens and the flow path FP2 is then directed into the accumulator. When, however, the accumulator pressure is high, indicating a full accumulator, check valve 146 remains closed and the flow is then directed through check valve 148 into branch FP6 to pass through the plenum cage 161 into the outlet flow path FP7. Of course, during all this time the initial low temperature of the hot water flow lifts plug 166 off of the sealing washer 168, keeping seat 143 open.

Once the thermostatic actuator 165 opens seal 164 then a second flow path branch FP5-2 is set up through the now open seal 164 to merge again with the flow path FP7, with the lower pressure at the open valve 14 then also communicated to the larger piston 142 of shuttle assembly 14 while at the same time the plug 166 closes seat 143, dropping the pressure volume at the smaller piston 141 while the larger piston 142 is exposed to the flow, thus once again forming a latching bias by the unequal sides of a single piston assembly.

Those skilled in the art will appreciate that when valve 14 is opened the reduced pressure on the larger piston 142 articulates the shuttle to open valve seat 143, exposing the lateral port 147 to convey the hot water flow from the inlet connection 38 to both the check valves 146 and 148 and if the accumulator back pressure behind check valve 146 is lower than the hot water pressure plus the check valve spring bias the flow will be collected in accumulator 40. Once this back pressure threshold is exceeded and no further water flow can be stored in the accumulator then check valve 148 opens directing the flow path through the plenum cage and thence directly out of the faucet valve 14. In this manner the basic function of the faucet assembly 11 is retained even during those instances when accumulator 40 is full.

It will be appreciated that each of the shuttle assemblies 120 and 140 operate as bi-stable hydraulic latches operating between the water pressure in the supply WS, the intermediate pressures set by the various check valves 126, 146 and 148 and the pressures at the outlets 26 and 28 when the corresponding valves 12 or 14 are opened. Since the bias levels of the springs associated with the corresponding check valves are each fully selectable and since the local pressure levels of the municipal water supply WS are well known a well-defined set of pressures can be developed across each shuttle every time a valve is opened. Moreover, the fully confined nature of each of the shuttle assemblies within valve block 20 confines all leakage across the seals thereof to the flow out of the faucet assembly, resulting in a reliable and virtually imperceptible manner of operation.

It will be appreciated that the shuttling translation of piston assembly 125, and by similar considerations also piston assembly 145, each entail a trapped volume that varies in size while confined between the respective piston seals. More precisely, the shuttle assembly 120 and the substantially similar shuttle assembly 140 each entail the shuttling translations of the smaller pistons 121 and 141 within mating bores 221 and 241 that are each sealed by corresponding O-rings 321 and 341. These shuttling strokes, of course, are each matched by linear strokes of equal length of the larger pistons 122 and 142 translating within their mating bores 222 and 242 across sealing O-rings 322 and 342 and since the bore volume trapped between both the seals 321 and 322 include an area transition from the smaller to the larger size the corresponding volumes of the piston assemblies 125 and 145 that are trapped between the seals change with the shuttling stroke times the piston area difference.

While the resulting pressure pulse consequent to this variation of the trapped volume can be minimized in known manners, e.g., by increasing the total trapped volume as compared to its change, or by allowing for controlled relieving leakages across the seals, the invention provides for a fully effected relieving arrangement of each of the trapped volumes. More precisely the invention includes a pair of opposed relief valves 421 and 422 at the ends of a common drilling 423 across shuttle assembly 120 communicating into the trapped volume between seals 321 and 322, respectively relieving any negative pulse by admitting air from the exterior or by transferring a positive spike into the other trapped volume between seals 341 and 342 around piston assembly 145. A further relief valve 444 across the larger piston 142 then allows any built up water in this trapped volume to be pushed out into the flow through valve 14.

Each of the relief valves in this circuit are sized to accommodate only small volumetric changes therefore their flow rate capacities may be limited to result in some flow restriction that will then dampen the impacts at the ends of the strokes while also bringing its average pressure to a level between the two relieving pressures. In this manner quiet and virtually imperceptible shuttle translations are effected in a structure in which all the leakage paths are confined to the flow paths of the hot and cold flows.

Figure 4:
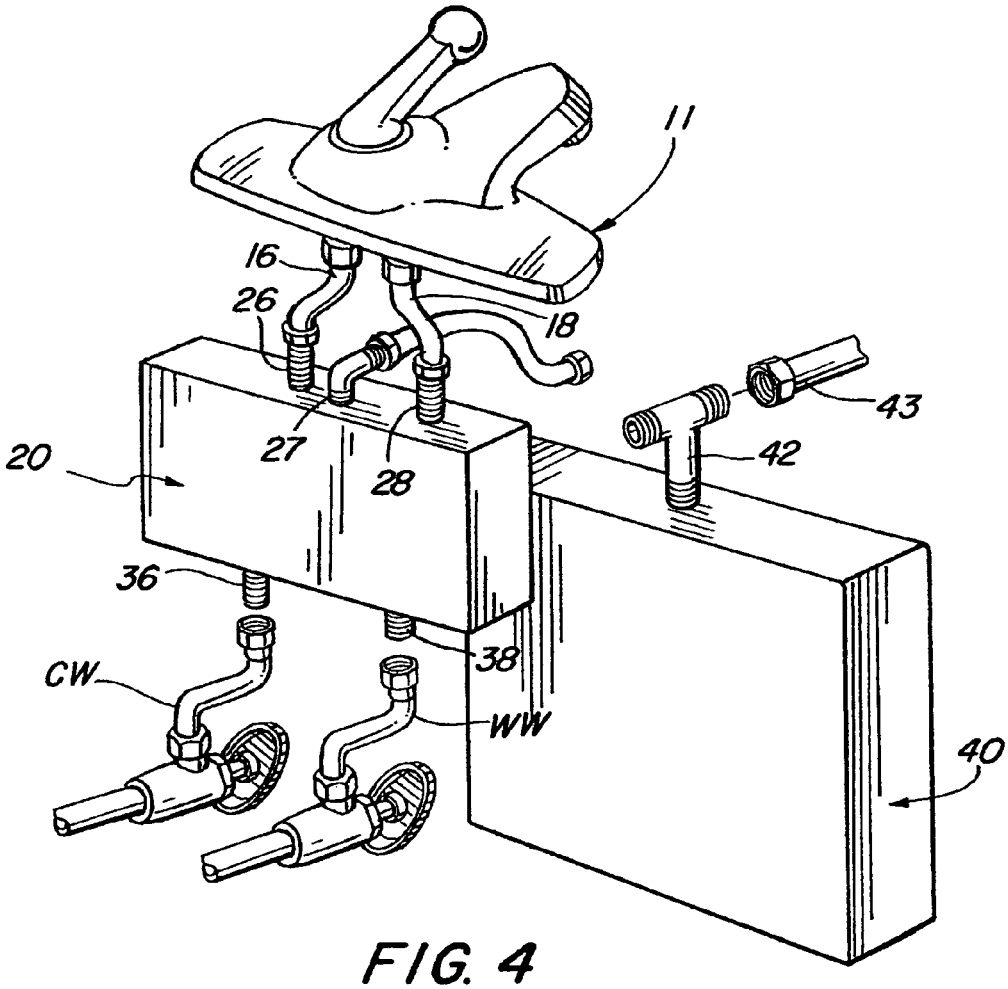
FIG. 4 is a perspective illustration, separated by parts, of a conventional faucet assembly adapted for connection to the inventive conservation system in its unitary form collectively arranged for installation convenience along with the replacement of the faucet assembly and including an interconnection between one or more accumulators serving plural inventive conservation systems deployed in adjacent proximity relative each other.
Figure 3:
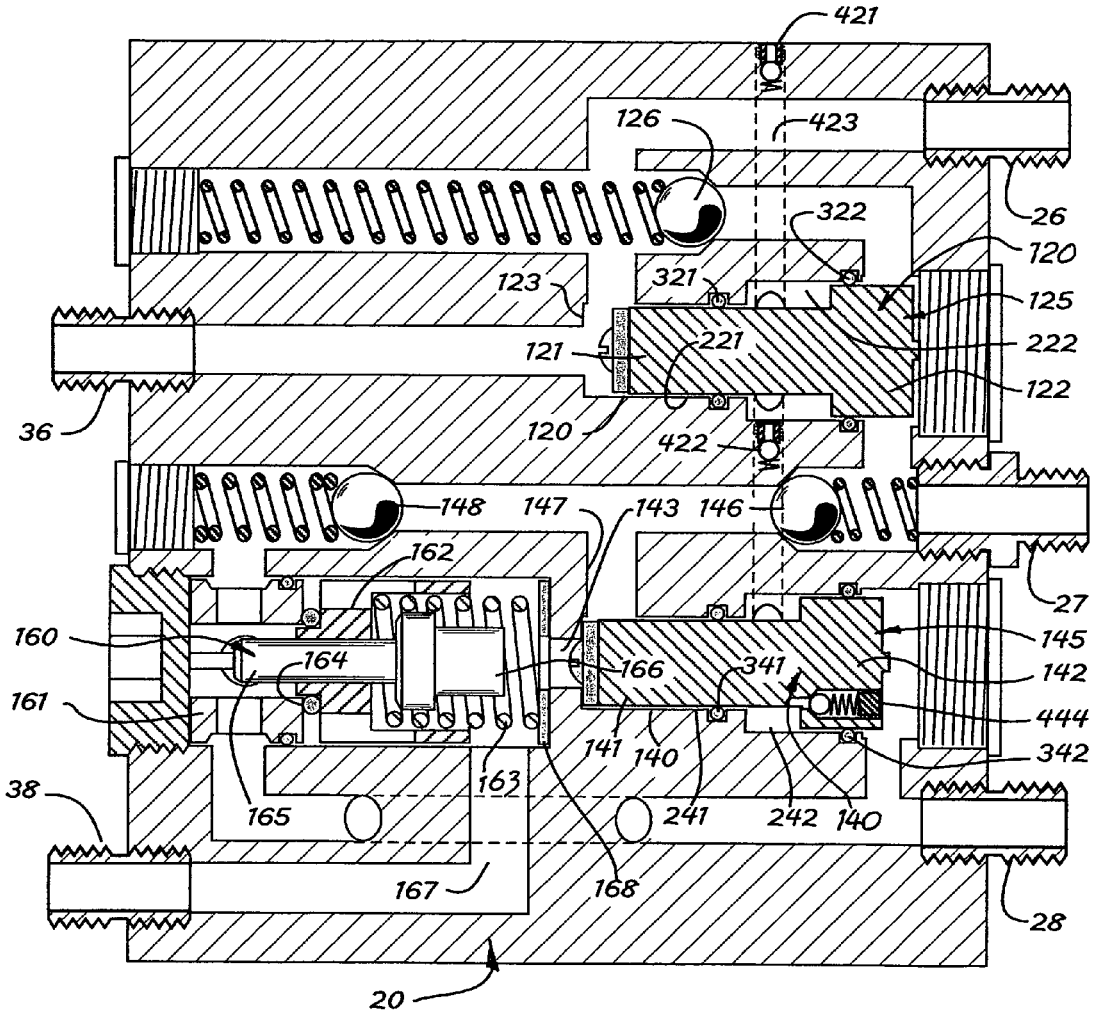
FIG. 3 is a sectional diagram of an integrated valve assembly including the several operative elements of the inventive conservation system interconnected by a manifold to form a unitary valve block.

While the inventive conservation system is described above with an accumulator 40 in a one-to-one association with a faucet assembly 11 and its associated valve block 20 such a rigorous association is not absolutely required. For example, as illustrated in FIG. 4, a tee connection 42 may be included at the accumulator inlet which then, through a connection tubing 43, can also service another faucet and valve block combination that is proximately deployed. Since construction economies are best effected when plumbing networks are branched to service adjoining areas this accumulator sharing convenience is particularly beneficial. These same clustered plumbing arrangements also reduce the effective volume of the plumbing branches to further enhance the conservation aspects obtained herein.

In this manner an easily installed and virtually imperceptible in use conservation system is devised that once widely distributed can obtain large reductions in clean water use. Simply, the user no longer needs to choose between an initially cold water flow and a conservative use of resources.

Obviously many modifications and variations of the instant invention can be effected without departing from the spirit of the teachings herein. It is therefore intended that the scope of the invention be determined solely by the claims appended hereto.

It is claimed:

1. An apparatus connectable between a hot water supply and a plumbing fixture hot water outlet and a cold water supply and a plumbing fixture cold water outlet for diverting into storage the initially cool portion of a hot water stream from the hot water supply and to discharge the diverted cool portion from storage upon opening of the plumbing fixture cold water outlet, comprising:

an accumulator having a pressure biasing member therein;

a hot water flow control valve having a thermostatic actuator selectively connecting the hot water supply to a cool water outlet when the temperature of water flowing through said hot water control valve is below a predetermined temperature or to a hot water outlet when the temperature of the water flowing through said hot water control valve exceeds the predetermined temperature; said cool water outlet flow connected to a cool water inlet of a hot water request valve; said hot water outlet flow connected to a hot water outlet line which is flow connected to the plumbing fixture hot water outlet;

said hot water request valve having a first piston selectively connecting said cool water inlet to a cool water discharge port in said hot water request valve when said plumbing fixture hot water outlet is opened and blocking said cool water discharge port from said cool water inlet when said plumbing fixture hot water outlet is closed;

said cool water discharge port of said hot water request valve flow connected to a cool water trunk line which splits into a storage branch flow connected to said accumulator and a cool water discharge branch flow connected to the plumbing fixture cold water outlet;

a cold water flow control valve having a cold water inlet flow connected to the cold water supply, a cold water outlet flow connected to the plumbing fixture cold water outlet and a second piston; said second piston selectively advanceable between a closed position in which said second piston blocks said cold water outlet from said cold water inlet and an open position in which said second piston is withdrawn from blocking said cold water outlet from said cold water inlet thereby flow connecting the cold water supply to the plumbing fixture cold water outlet; said second piston is in communication with said cool water discharge branch and said cold water supply and configured such that pressure in said cool water discharge branch advances said second piston to said closed position until the pressure in the cold water supply exceeds a preselected multiple of the pressure in said cool water discharge branch;

said pressure biasing member increasing the pressure exerted on water in said accumulator, said storage branch and said cool water discharge branch as the volume of water in said accumulator increases; and wherein water flowing into said cool water trunk line through said hot water request valve flows into said accumulator through said storage branch until the pressure exerted on the water in said accumulator by the pressure biasing member approaches the pressure of the water flowing into said cool water trunk line;

and when said plumbing fixture cold water outlet is opened, water contained in said accumulator is urged out of said accumulator and out said plumbing fixture cold water outlet through said storage branch and said cool water discharge branch until the pressure of the water in the cold water supply exceeds the preselected multiple of the pressure in the cool water discharge branch exerted thereon by said pressure biasing member in said accumulator.

2. The apparatus as in claim 1 further comprising a first check valve on said cool water trunk line preventing water flowing from said accumulator to said hot water request valve.

3. The apparatus as in claim 2 further comprising a bypass check valve connected to a bypass branch off of said cool water trunk line; said bypass branch connected to said hot water outlet line downstream of said bypass check valve; said bypass check valve opening when the pressure of water flowing into the cool water trunk line from the hot water request valve is less than the pressure exerted on the water in the accumulator and said storage branch by said pressure biasing member.

4. The apparatus as in claim 2 further comprising a second check valve on said cool water discharge branch preventing water flowing from said cold water supply through said cold water flow control valve from flowing past said second check valve to said storage branch.

5. An apparatus connectable between a hot water supply and a plumbing fixture hot water outlet and a cold water supply and a plumbing fixture cold water outlet for diverting into storage the initially cool portion of a hot water stream from the hot water supply and to discharge the diverted cool portion from storage upon opening of the plumbing fixture cold water outlet, comprising:

an accumulator having a pressure biasing member therein;

a hot water flow control valve having a thermostatic actuator selectively connecting the hot water supply to a cool water outlet when the temperature of water flowing through said hot water control valve is below a predetermined temperature or to a hot water outlet when the temperature of the water flowing through said hot water control valve exceeds the predetermined temperature; said cool water outlet flow connected to a cool water inlet of a hot water request valve; said hot water outlet flow connected to a hot water outlet line which is flow connected to the plumbing fixture hot water outlet;

said hot water request valve having a first piston selectively connecting said cool water inlet to a cool water discharge port in said hot water request valve when said plumbing fixture hot water outlet is opened and blocking said cool water discharge port from said cool water inlet when said plumbing fixture hot water outlet is closed;

said cool water discharge port of said hot water request valve flow connected to a cool water trunk line which splits into a storage branch flow connected to said accumulator and a cool water discharge branch flow connected to the plumbing fixture cold water outlet;

a cold water flow control valve having a cold water inlet flow connected to the cold water supply, a cold water outlet flow connected to the plumbing fixture cold water outlet and a second piston having a first end and a second end; said second piston selectively advanceable between a closed position in which said first end blocks said cold water outlet from said cold water inlet and an open position in which said second end is withdrawn from blocking said cold water outlet from said cold water inlet thereby connecting the cold water supply through the cold water inlet to the plumbing fixture cold water outlet through said cold water outlet; said second end of said second piston is in communication with said cool water discharge branch and has a larger surface area in communication with said cool water discharge branch than the surface area of said first end of said second piston in communication with said cold water supply such that pressure in said cool water discharge branch advances said second piston to said closed position until the pressure in the cold water supply exceeds a preselected multiple of the pressure in said cool water discharge branch corresponding to the ratio of the surface area of the second piston second end in communication with said cool water discharge branch to the surface area of the second piston first end in communication with the cold water supply;

said pressure biasing member increasing the pressure exerted on water in said accumulator, said storage branch and said cool water discharge branch as the volume of water in said accumulator increases; and wherein water flowing into said cool water trunk line through said hot water request valve flows into said accumulator through said storage branch until the pressure exerted on the water in said accumulator by the pressure biasing member approaches the pressure of the water flowing into said cool water trunk line;

and when said plumbing fixture cold water outlet is opened, water contained in said accumulator is urged out of said accumulator and out said plumbing fixture cold water outlet through said storage branch and said cool water discharge branch until the pressure of the water in the cold water supply exceeds the preselected multiple of the pressure in the cool water discharge branch exerted thereon by said pressure biasing member in said accumulator.

6. The apparatus as in claim 5 further comprising a first check valve on said cool water trunk line preventing water flowing from said accumulator to said hot water request valve.

7. The apparatus as in claim 5 further comprising a bypass check valve connected to a bypass branch off of said cool water trunk line; said bypass branch connected to said hot water outlet line downstream of said bypass check valve; said bypass check valve opening when the pressure of water flowing into the cool water trunk line from the hot water request valve is less than the pressure exerted on the water in the accumulator and said storage branch by said pressure biasing member.

8. The apparatus as in claim 6 further comprising a second check valve on said cool water discharge branch preventing water flowing from said cold water supply through said cold water flow control valve from flowing past said second check valve to said storage branch.

9. An apparatus connectable between a hot water supply and a plumbing fixture hot water outlet and between a cold water supply and a plumbing fixture cold water outlet for diverting into storage the initially cool portion of a hot water stream from the hot water supply and to discharge the diverted cool portion from storage upon opening of the plumbing fixture cold water outlet, comprising:

an accumulator including a pressure biasing member within said accumulator;

a hot water flow control valve including a thermostatic actuator connected to a valve member mounted within a hot water flow control valve body having a hot water supply inlet flow connected to the hot water supply, a cool water outlet and a hot water outlet; said cool water outlet flow connected to a pressure responsive, hot water request valve; said hot water outlet flow connected to a hot water outlet line which is flow connected to the plumbing fixture hot water outlet; said thermostatic actuator advancing said valve member between a retracted position when the temperature of the water in said hot water flow control valve is below a predetermined temperature and an extended position when the temperature of the water therein exceeds the predetermined temperature; when said valve member is in said retracted position said valve member closes said hot water outlet and opens said cool water outlet to the flow of water from said hot water supply inlet; when said valve member is in said extended position said valve member closes said cool water outlet and opens said hot water outlet to the flow of water from said hot water supply inlet;

said hot water request valve having a first piston mounted within a hot water request valve body having a cool water inlet and cool water discharge port and a first piston actuation opening formed therein; said cool water inlet flow connected to said cool water outlet of said hot water flow control valve; said cool water discharge port flow connected to a cool water trunk line which splits into a storage branch flow connected to said accumulator and a cool water discharge branch flow connected to the plumbing fixture cold water outlet; said first piston advanceable between a closed position in which said first piston blocks flow of water from said cool water inlet to said cool water discharge port and an open position in which said first piston does not block flow of water from said cool water inlet to said cool water discharge port; said first piston actuation opening is in flow communication with said hot water outlet line;

said first piston is configured such that when the plumbing fixture hot water outlet is closed, the water pressure in said hot water outlet line advances said first piston to the closed position, and when said plumbing fixture hot water outlet is opened, with the valve member of the hot water flow control valve in the retracted position, water pressure acting on said first piston from the hot water supply through said hot water supply inlet advances said first piston to the open position allowing water from the hot water supply to flow through said hot water flow control valve body and out said cool water outlet, through the cool water inlet and discharge port in the hot water request valve body and into the cool water trunk line; when the temperature of the water flowing through said hot water flow control valve exceeds the predetermined temperature the valve member advances to the extended position and water flows out the hot water outlet and into the hot water outlet line and to the plumbing fixture hot water outlet; and wherein when said plumbing fixture cold water outlet is closed, water flowing into said cool water trunk line flows into said accumulator through said storage branch and when said plumbing fixture cold water outlet is open, water contained in said accumulator is urged out of said accumulator by said pressure biasing member and out said plumbing fixture cold water outlet through said storage branch and said cool water discharge branch along with water flowing from said hot water request valve through said cool water trunk line.

10. The apparatus as in claim 9 further comprising:

a cold water flow control valve having a second piston mounted within a cold water flow control valve body having a cold water inlet and cold water outlet and a second piston actuation opening formed therein; said cold water inlet flow connected to said cold water supply, said cool water outlet flow connected to said cool water discharge branch flow connected to the plumbing fixture cold water outlet; said second piston advanceable between a closed position in which said second piston blocks flow of water from said cold water inlet to said cold water outlet and an open position in which said second piston does not block flow of water from said cold water inlet to said cold water outlet;

a second piston actuating branch extending in flow communication between said cool water discharge branch and said second piston actuation opening in said cold water flow control valve body;

wherein said second piston is configured such that when the plumbing fixture cold water outlet is closed the pressure of the water in said second piston actuating branch acting on the second piston advances said second piston to the closed position, and when said plumbing fixture cold water outlet is opened and the pressure of the water acting against the second piston through the cold water inlet exceeds a multiple of the pressure of the water acting against the second piston through the second piston actuation opening said second piston advances to said second piston to said open position.

11. The apparatus as in claim 9 further comprising a first check valve on said cool water trunk line preventing water flowing from said accumulator to said hot water request valve.

12. The apparatus as in claim 9 further comprising a bypass check valve connected to a bypass branch off of said cool water trunk line; said bypass branch connected to said hot water outlet line downstream of said bypass check valve; said bypass check valve opening when the pressure of water flowing into the cool water trunk line from the hot water request valve is less than the water pressure in said storage branch.

13. The apparatus as in claim 11 further comprising a second check valve on said cool water discharge branch preventing water flowing from said cold water supply through said cold water flow control valve from flowing past said check valve to storage branch.

* * * * *